US006186120B1

(12) United States Patent
Guentert et al.

(10) Patent No.: US 6,186,120 B1
(45) Date of Patent: Feb. 13, 2001

(54) HIGH PRESSURE PUMP FOR SUPPLYING FUEL IN FUEL INJECTION SYSTEM OF INTERNAL COMBUSTION ENGINES

(75) Inventors: Josef Guentert, Gerlingen; Juergen Hammer, Fellbach, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/355,502

(22) PCT Filed: Nov. 17, 1998

(86) PCT No.: PCT/DE98/03379

§ 371 Date: Jul. 29, 1999

§ 102(e) Date: Jul. 29, 1999

(87) PCT Pub. No.: WO99/31383

PCT Pub. Date: Jun. 24, 1999

(30) Foreign Application Priority Data

Dec. 17, 1997 (DE) ..... 197 56 087

(51) Int. Cl.[7] ..... F02M 33/04
(52) U.S. Cl. ..... 123/459; 123/456; 123/514
(58) Field of Search ..... 123/457, 458, 123/510, 511, 514

(56) References Cited

U.S. PATENT DOCUMENTS 4,838,232 * 6/1989 Wich ..... 123/458
5,085,193 * 2/1992 Morikawa ..... 123/458
5,718,207 * 2/1998 Ito ..... 123/458
5,785,025 * 7/1998 Yoshiume et al. ..... 123/511
5,884,606 * 3/1999 Kellner et al. ..... 123/458
5,915,361 * 6/1999 Heinz et al. ..... 123/458

FOREIGN PATENT DOCUMENTS 1 97 01 392 A1 7/1997 (DE) .
0 481 964 A2 11/1989 (EP) .
0 735 268 A2 3/1996 (EP) .

OTHER PUBLICATIONS

Aktuell, Pumpen–Pionier, p. 62, 1997.

* cited by examiner

*Primary Examiner*—Thomas N. Moulis
(74) *Attorney, Agent, or Firm*—Ronald E. Greigg; Edwin E. Greigg

(57) ABSTRACT

A high-pressure pump for supplying fuel in a fuel injection system of an internal combustion engine, including a common rail injector system. The fuel injection system includes a low-pressure part that contains a fuel tank and a prefeed pump and a high-pressure part that contains a high-pressure pump and a common rail into which a fuel flow is fed from the high-pressure pump through a common conduit. The high-pressure pump system solves a problem in that there is an integrated demand-based quantity control for the fuel flow pumped by the high-pressure pump. The demand-based quantity control integrated with the high-pressure pump contributes to improving the overall engine efficiency, because the power consumption by the high-pressure pump drops as a result.

13 Claims, 3 Drawing Sheets

HIGH PRESSURE PUMP FOR SUPPLYING FUEL IN FUEL INJECTION SYSTEM OF INTERNAL COMBUSTION ENGINES

PRIOR ART

The invention relates to a high-pressure pump for fuel a supply in fuel injection systems of internal combustion engines, in particular in a common rail injection system, in which the fuel injection system includes a low-pressure part that contains a fuel tank and a prefeed pump and a high-pressure part that contains a high-pressure pump and a common distributor strip, or common rail, into which a fuel flow is fed from the high-pressure pump through a common conduit.

In conventional fuel injection systems of this type, normally a constant fuel flow is pumped by the prefeed pump into individual elements of the high-pressure pump, regardless of demand. The individual elements of the high-pressure pump may for instance be a plurality of cylinders, in each of which one piston can reciprocate in order to aspirate the fuel and impose high pressure on the fuel. If a constant rpm-dependent fuel supply is pumped by the high-pressure pump into the common rail regardless of demand, this means that the power consumption of the high-pressure pump is constant even if the demand is dropping. This has an unfavorable effect on the overall efficiency of the engine. The excess fuel quantity, compressed to high pressure, must moreover be diverted from the high-pressure pump again, which leads to temperature changes in the fuel.

To improve the overall efficiency of the engine, it has already been proposed that a regulated electric low-pressure feed pump be used for controlling the fuel flow to the individual elements of the high-pressure pump. This has the disadvantage, however, that damage from cavitation can occur in the intake stroke of the high-pressure pump.

It has also been proposed, in European Patent 0 481 964, to control the filling of each of the individual elements of the high-pressure pump with a respective magnet valve. This is very complicated, however, and entails high costs, since one magnet valve is needed for each element of the high-pressure pump.

An object of the invention is therefore to furnish a high-pressure pump which overcomes the above disadvantages. In particular, damage to the individual elements of the high-pressure pump during operation is to be avoided. Furthermore, a high-pressure pump of simple design, which meets stringent safety requirements and can nevertheless be produced economically, is to be created.

This object is attained by the high-pressure pump set forth hereinafter. Particular types of embodiment of the invention are disclosed hereinafter.

In a high-pressure pump for fuel supply in fuel injection systems of internal combustion engines, in particular in a common rail injection system, in which the fuel injection system includes a low-pressure part that contains a fuel tank and a prefeed pump and a high-pressure part that contains a high-pressure pump and a common rail into which a fuel flow is fed from the high-pressure pump through a common conduit, the object of the invention is attained in that an integrated demand-based quantity control for the fuel flow pumped by the high-pressure pump is integrated with the pump. The demand-based quantity control integrated with the high-pressure pump contributes to improving the overall engine efficiency, because the power consumption of the high-pressure pump drops as a result. The demand-based quantity control of the fuel flow pumped by the high-pressure pump offers the advantage that incomplete filling of the individual elements of the high-pressure pump is averted. This lessens the risk of cavitation.

One particular type of embodiment of the invention is characterized in that the demand-based quantity control includes a multi-way valve, which furnishes the fuel flow pumped by the high-pressure pump either to the common rail or to the low-pressure part of the fuel injection system, as needed. This makes it possible to regulate to a desired set-point value, by means of a suitable regulation strategy. The high-pressure pump then acts as an adjuster in the pressure regulation circuit. The demand-based quantity control of the fuel flow pumped by the high-pressure pump is advantageously accomplished with only a single multi-way valve. This saves on the cost of producing the high-pressure pump. It advantageously reduces the installation space required by the high-pressure pump as well.

Another particular type of embodiment of the invention is characterized in that the multi-way valve is a 3/2-way valve, which is mounted in the common conduit and which connects the common conduit in a first valve position, to the common rail and, in a second valve position, to the low-pressure part of the fuel injection system. In the second valve position, the fuel flow returns, pressureless, to the low-pressure part of the fuel injection system without being subjected to high pressure. The fuel flow can be returned either to the fuel tank or to the connecting line between the prefeed pump and the high-pressure pump. Because the entire fuel flow is pumped by the high-pressure pump, dividing it into a feed flow and a lubricating flow in the low-pressure part can be dispensed with.

Another particular type of embodiment of the invention is characterized in that a check valve is disposed between the multi-way valve and the common rail. In the first valve position, the common conduit communicates with the common rail. By means of the check valve disposed between the multi-way valve and the common rail, it is attained that the fuel is compressed by the individual elements of the high-pressure pump until such time as a desired pressure is reached. Once the desired pressure is attained, the check valve opens, and the fuel flows into the common rail. Thus the fuel is aspirated at high pressure in the high-pressure pump only when the multi-way valve is in the first valve position.

Another particular type of embodiment of the invention is characterized in that the multi-way valve is magnetically actuatable. By means of the magnetic actuation, short switching times can be attained.

Another particular type of embodiment of the invention is characterized in that the high-pressure pump is a radial piston pump that includes a drive shaft, which is supported in a pump housing and is embodied eccentrically or having camlike protrusions in the circumferential direction, and preferably a plurality of pistons, disposed radially relative to the drive shaft in a respective cylinder chamber, which are movable radially back and forth in the respective cylinder chamber by rotation of the drive shaft. Such radial piston pumps are especially well suited to common rail injection systems. As the pistons reciprocate, fuel is first aspirated and then compressed.

The present invention has the advantage in general that it can be made simply and economically. The fundamental concept of the present invention can moreover be employed in a simple way in conventional high-pressure pumps, because known components of conventional high-pressure pumps can be used. This keeps both development effort and costs low.

Further advantages, characteristics and details of the invention will become apparent from the ensuing description, in which one exemplary embodiment is described in detail with reference to the drawings. Characteristics recited in the claims and mentioned in the description may be essential to the invention either individually or in arbitrary combination with one another. One way of realizing the claimed invention is explained below in detail in conjunction with the drawings.

DETAILED DESCRIPTION

Figure 1:
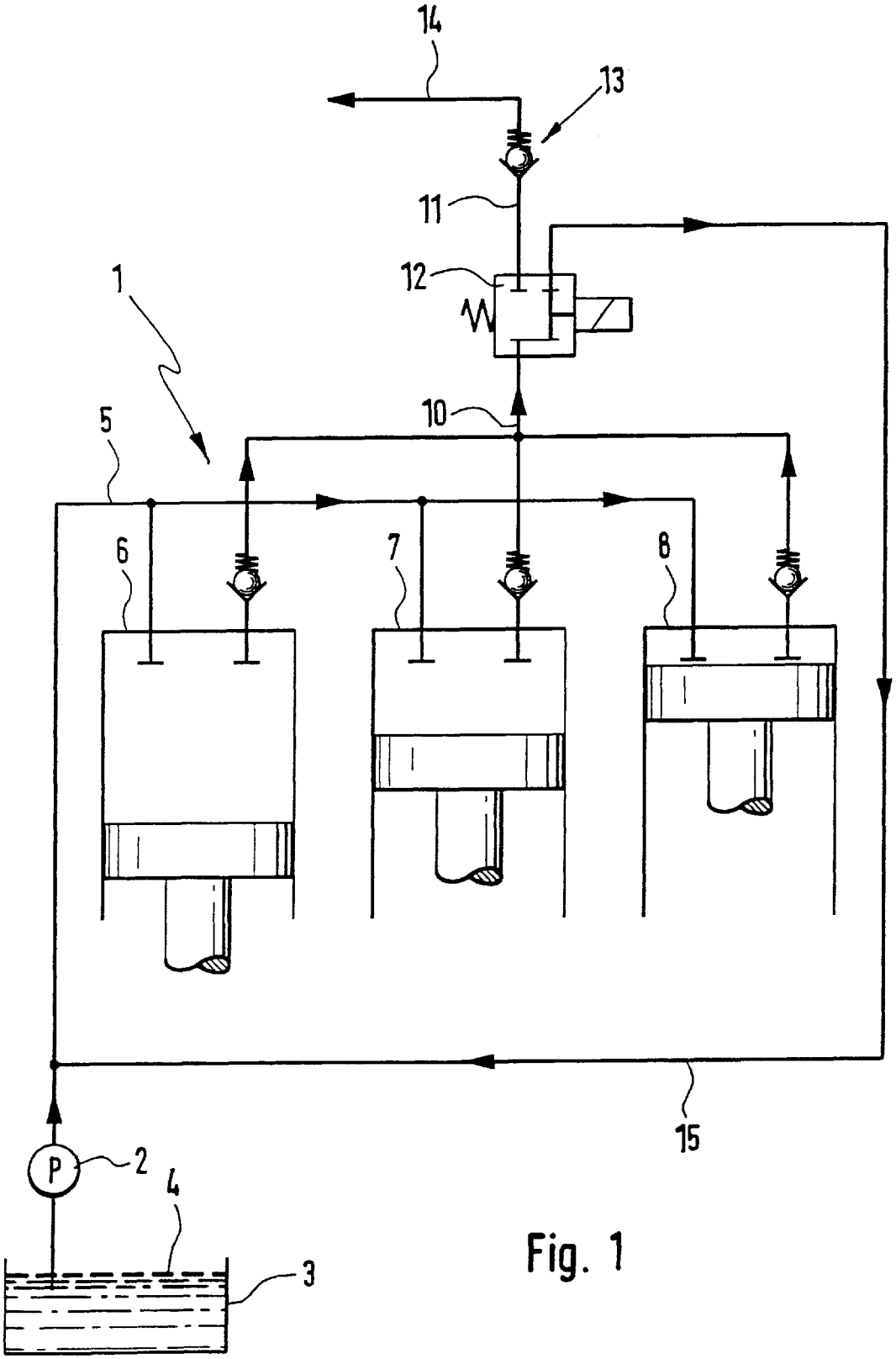
FIG. 1 schematically shows a fuel injection system with a high-pressure pump and a multi-way valve in a first valve position.

FIG. 1 is a schematic view of a fuel injection system with a high-pressure pump according to the invention; this pump is identified in general by reference numeral 1. A prefeed pump 2 furnishes fuel 4 from a tank 3 to the high-pressure pump 1 through a fuel line 5. The high-pressure pump 1 includes three elements 6, 7, 8. The elements 6, 7, 8 are each embodied by one cylinder, in which a piston can reciprocate. When the pistons shown in FIG. 1 are moving downward, fuel is aspirated by the fuel line 5. When the pistons are moving upward, the fuel contained in the cylinders is compressed and pumped into a common conduit 10.

A magnet-controlled 3/2-way valve 12 is built into the common conduit 10. In the position of the multi-way valve 12 shown in FIG. 1, the fuel from the common conduit reaches the fuel line 5 again, via a return line 15.

Figure 2:
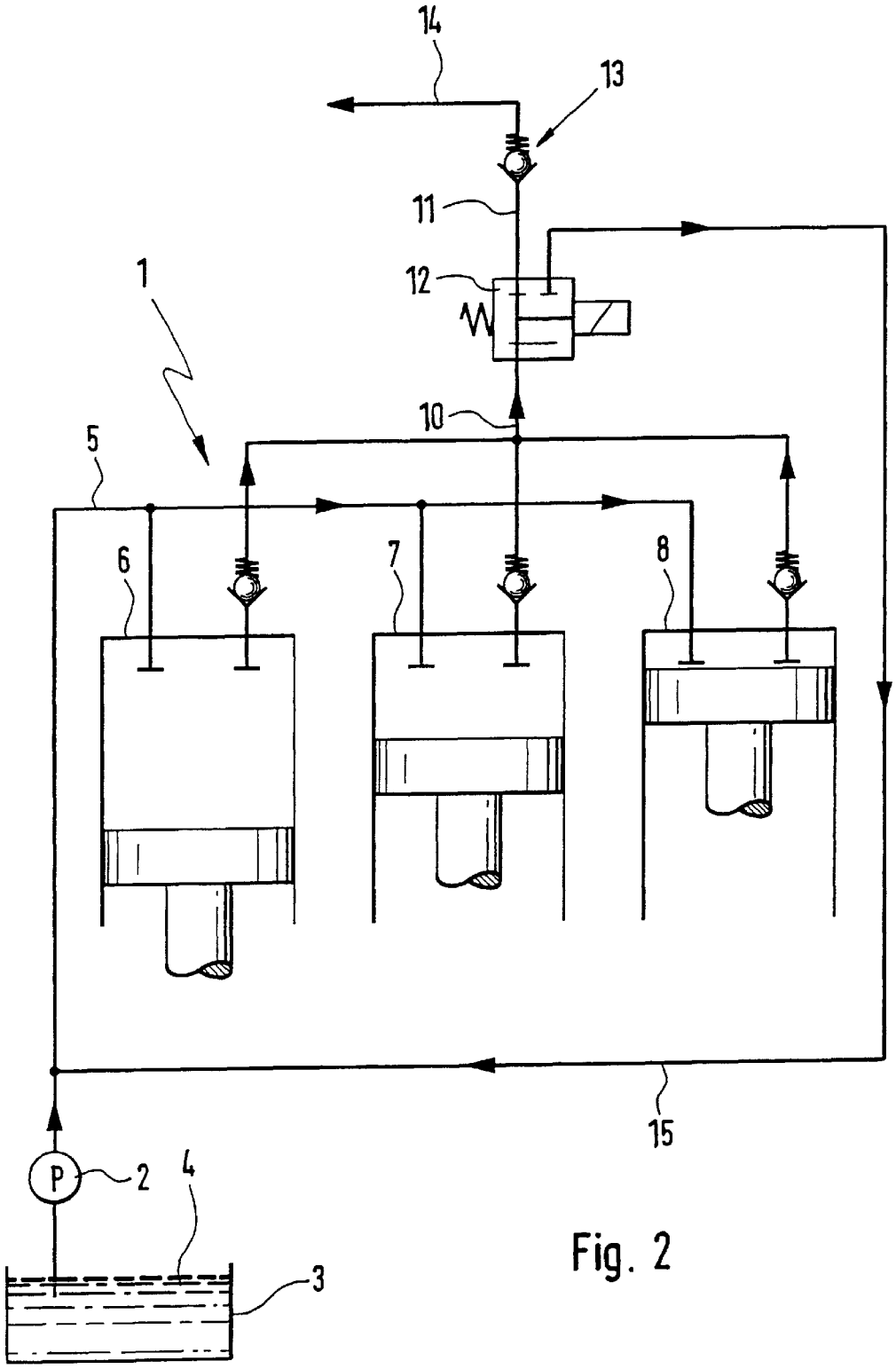
FIG. 2 schematically shows the fuel injection system of FIG. 1 with the multi-way valve in a second valve position.

In FIG. 2, the same fuel injection system as in FIG. 1 is shown. The sole difference is that the valve 12 is in a different position. In the position of the multi-way valve 12 shown in FIG. 2, the fuel from the common conduit 10 reaches a conduit 11, in which a check valve 13 is mounted. In operation of the high-pressure pump 1, fuel is pumped into the conduit 11 by the elements 6, 7, 8 until the pressure is so high that the check valve 13 opens. The fuel, subjected to high pressure, then reaches a common rail, not shown, via a line 14.

Figure 3:
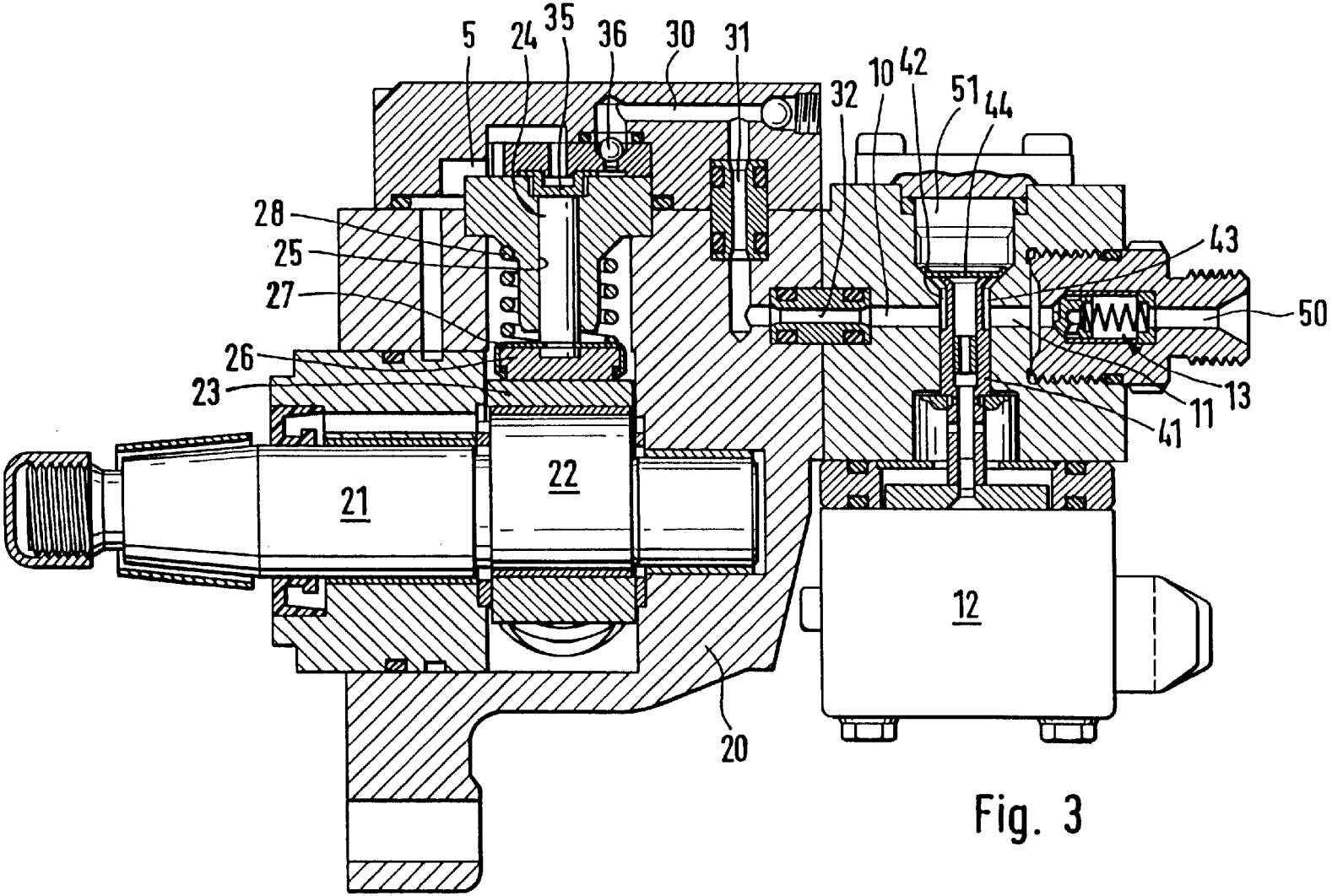
FIG. 3 shows one embodiment of a high-pressure pump of the invention.

The high-pressure pump shown in FIG. 3 is a radial piston pump for supplying fuel at high pressure in fuel injection systems of internal combustion engines. The radial piston pump includes a drive shaft 21, supported in a pump housing 20 and having an eccentrically embodied shaft portion 22. A ring 23 relative to which the shaft portion 22 is rotatable is provided on the eccentric shaft portion. The ring 23 includes a plurality of flat faces, offset from one another, against each of which a respective piston 24 is braced. The pistons are each received in a respective cylinder chamber 25 such that they can reciprocate radially relative to the drive shaft 21. The base of the piston 24 is embodied as a plate 26, which contacts the ring 23. The plate 26 is secured by a respective cage 27 to the piston 24 and is pressed against the ring 23 by a spring 28.

When the drive shaft 21 is set into rotation, the eccentricity of the shaft portion 22 causes the pistons 24 to reciprocate in the cylinder chambers 25. When the piston 24 is moving toward the drive shaft 21, fuel is aspirated from a fuel line 5 into the cylinder chamber 25. When the piston 24 moves away from the drive shaft 21, fuel located in the cylinder chamber 25 is pumped into a common conduit 10 via conduits 30, 31, 32. The fuel is pumped into the common conduit 10 from all the cylinder chambers. In the sectional view shown in FIG. 3, only one cylinder chamber 25 is visible, but as a rule a plurality of cylinder chambers 25 are disposed radially to the drive shaft 21.

During the pumping stroke, a check valve 35 assures that the fuel is not pumped out of the cylinder chamber 25 into the fuel line 5. A check valve 36 correspondingly assures that during the intake stroke the fuel is not aspirated from the common conduit 10 into the cylinder chamber 25.

A 3/2-way valve 12 is mounted in the common conduit 10.

The multi-way valve 12 has a cylindrical body 41 with a trumpet-shaped closing element 44. Openings 42, 43 are provided in the cylindrical body 41. In the position of the multi-way valve 12 shown in FIG. 2, the fuel from the common conduit can pass into a conduit 11 through the openings 42, 43 in the valve body 41. A check valve 13 is mounted in the conduit 11.

When the pressure in the conduit attains what is known as the rail pressure, the check valve 13 opens, and the fuel, subjected to high pressure, passes through a conduit 50 via a high-pressure line to reach a common distributor strip, which is known as a common rail and is not shown in FIG. 3. In the position of the 3/2-way valve 12 shown in FIG. 3, fuel subject to high pressure is accordingly pumped into the common rail. When fuel is no longer needed, the 3/2-way valve changes over to its second position.

In the second position, not shown, of the 3/2-way valve, the cylindrical valve body 41 is displaced upward in such a way that the valve body closes the conduit 11. At the same time, the trumpet-shaped closing element 44 lifts from its seat, so that the fuel from the conduit 10 enters a chamber 41, which communicates with a return line, not shown. In the second valve position, the unneeded fuel is accordingly not subjected to high pressure.

The foregoing relates to a preferred exemplary embodiments of the invention, it being understood that other variants and embodiments thereof are possible within the spirit and scope of the invention, the latter being defined by the appended claims.

What is claimed is:

1. A high pressure pump for supplying fuel in a fuel injection system of internal combustion engines, including a common rail injection system, in which the fuel injection system comprises a low-pressure pump (2), a fuel tank (3) which supplies fuel to the low pressure pump, a high-pressure pump (1), said high pressure pump including more than one piston (6, 7, 8), a common conduit (10) into which a fuel flow is fed from each of the more than one piston of the high-pressure pump (1), said fuel injection system has an integrated demand-based multi-way quantity control valve (12) operatively connected in the common conduit (10) between the high pressure pump and the common rail for controlling the fuel flow pumped by the high-pressure pump (1) to the common rail or for returning a part of the fuel to the fuel tank.

2. The high-pressure pump according to claim 1, in which the multi-way valve is a 3/2-way valve (12), which is mounted in the common conduit (10) and which connects the common conduit (10), in a first valve position, to the common rail and, in a second valve position, to the low-pressure part of the fuel injection system.

3. The high-pressure pump according to claim 2, in which a check valve (13) is disposed between the multi-way valve (12) and the common rail.

4. The high-pressure pump according to claim 2, in which the multi-way valve (12) is magnetically actuatable.

5. The high-pressure pump according to claim 3, in which the multi-way valve (12) is magnetically actuatable.

6. The high-pressure pump according to claim 1, in which the high-pressure pump is a radial piston pump that includes a drive shaft (21), which is supported in a pump housing (20) and is embodied eccentrically in a circumferential direction, and a plurality of pistons (24) are disposed radially relative to the drive shaft (21) in respective cylinder chambers (25), said pistons are moved radially back and forth in the respective cylinder chamber (25) by rotation of the drive shaft (21).

7. The high-pressure pump according to claim 2, in which the high-pressure pump is a radial piston pump that includes a drive shaft (21), which is supported in a pump housing (20) and is embodied eccentrically in a circumferential direction, and a plurality of pistons (24) are disposed radially relative to the drive shaft (21) in respective cylinder chambers (25), said pistons are moved radially back and forth in the respective cylinder chamber (25) by rotation of the drive shaft (21).

8. The high-pressure pump according to claim 3, in which the high-pressure pump is a radial piston pump that includes a drive shaft (21), which is supported in a pump housing (20) and is embodied eccentrically in a circumferential direction, and a plurality of pistons (24) are disposed radially relative to the drive shaft (21) in respective cylinder chambers (25), said pistons are moved radially back and forth in the respective cylinder chamber (25) by rotation of the drive shaft (21).

9. The high-pressure pump according to claim 5, in which the high-pressure pump is a radial piston pump that includes a drive shaft (21), which is supported in a pump housing (20) and is embodied eccentrically in a circumferential direction, and a plurality of pistons (24) are disposed radially relative to the drive shaft (21) in respective cylinder chambers (25), said pistons are moved radially back and forth in the respective cylinder chamber (25) by rotation of the drive shaft (21).

10. The high-pressure pump according to claim 1, in which the high-pressure pump is a radial piston pump that includes a drive shaft (21), which is supported in a pump housing (20) and has camlike protrusions in a circumferential direction, and a plurality of pistons (24) disposed radially relative to the drive shaft (21) in respective cylinder chambers (25), said pistons are moved radially back and forth in the respective cylinder chamber (25) by rotation of the drive shaft (21).

11. The high-pressure pump according to claim 2, in which the high-pressure pump is a radial piston pump that includes a drive shaft (21), which is supported in a pump housing (20) and has camlike protrusions in a circumferential direction, and a plurality of pistons (24) disposed radially relative to the drive shaft (21) in respective cylinder chambers (25), said pistons are moved radially back and forth in the respective cylinder chamber (25) by rotation of the drive shaft (21).

12. The high-pressure pump according to claim 3, in which the high-pressure pump is a radial piston pump that includes a drive shaft (21), which is supported in a pump housing (20) and has camlike protrusions in a circumferential direction, and a plurality of pistons (24) disposed radially relative to the drive shaft (21) in respective cylinder chambers (25), said pistons are moved radially back and forth in the respective cylinder chamber (25) by rotation of the drive shaft (21).

13. The high-pressure pump according to claim 5, in which the high-pressure pump is a radial piston pump that includes a drive shaft (21), which is supported in a pump housing (20) and has camlike protrusions in a circumferential direction, and a plurality of pistons (24) disposed radially relative to the drive shaft (21) in respective cylinder chambers (25), said pistons are moved radially back and forth in the respective cylinder chamber (25) by rotation of the drive shaft (21).

* * * * *